US006042399A

United States Patent [19]

Jaakkola

[11] Patent Number: 6,042,399

[45] Date of Patent: Mar. 28, 2000

[54] POWER TAKE-OFF ADAPTER FOR A TRACK

[75] Inventor: Risto Jaakkola, Espoo, Finland

[73] Assignee: Nordic Aluminium Oyj, Kirkkonummi, Finland

[21] Appl. No.: 09/125,945

[22] PCT Filed: Mar. 13, 1997

[86] PCT No.: PCT/FI97/00168

§ 371 Date: Jan. 4, 1999

§ 102(e) Date: Jan. 4, 1999

[87] PCT Pub. No.: WO97/34353

PCT Pub. Date: Sep. 18, 1997

[30] Foreign Application Priority Data

Mar. 13, 1996 [FI] Finland ..... 961179
Dec. 18, 1996 [FI] Finland ..... 965099

[51] Int. Cl.[7] ..... H01R 25/00

[52] U.S. Cl. ..... 439/122

[58] Field of Search ..... 439/121, 94, 110, 439/122, 118, 117, 116; 200/51 R, 51.05

[56] References Cited

U.S. PATENT DOCUMENTS 3,718,886 2/1973 Hoffmeister .
3,993,385 11/1976 Seger ..... 339/21 R
4,181,388 1/1980 Donato ..... 339/21 R
4,494,808 1/1985 Widell et al. ..... 339/21 R
5,038,005 8/1991 Hohorst et al. ..... 200/51.06

FOREIGN PATENT DOCUMENTS 2 140 983 5/1984 United Kingdom ..... H01R 25/14
2140983 12/1984 United Kingdom ..... H01R 25/14
WO 9424731 10/1994 WIPO ..... H01R 25/14

*Primary Examiner*—Neil Abrams
*Assistant Examiner*—Chandrika Prasad
*Attorney, Agent, or Firm*—Sughrue, Mion, Zinn, Macpeak & Seas, PLLC

[57] ABSTRACT

A power take-off adapter for a track having a connection slot and current conductors includes locking and contact fingers (8, 9) for connecting the power take-off adapter arranged in the connection slot of the track mechanically to the track and electrically to the current conductors of the track, a switching device (10) that is switched to move the locking fingers to a connecting position in which they protrude from a switching member (5) and to a retracted disconnnecting position. To provide a simple construction, the locking and contact fingers are arranged on the same axle member. A rotary movement of the switching device is arranged to bring all the contact fingers in contact with the current conductors of the track. The power take-off adapter is provided with a selecting switch (11) by which it is electrically connected to the desired phase conductor or electrically disconnected from the phase conductor.

10 Claims, 4 Drawing Sheets

Figure 1:
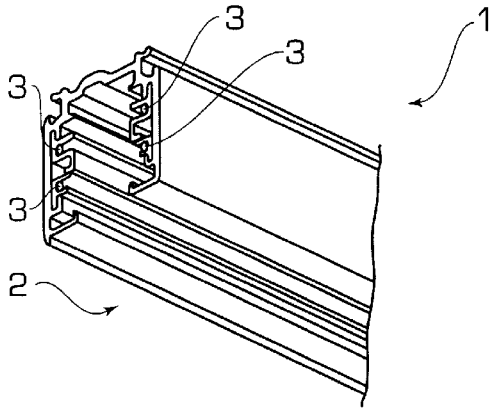

FIG. 5
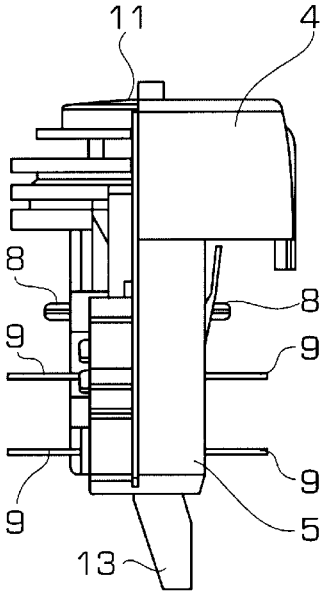
FIG. 6
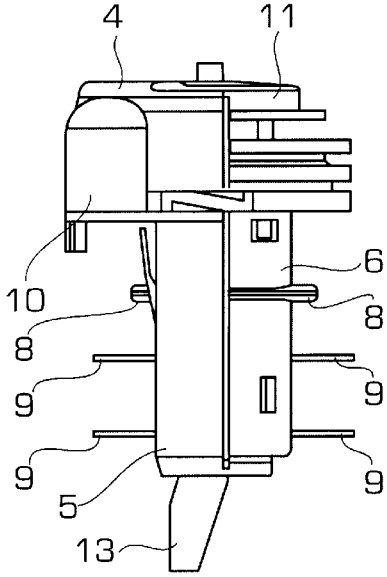
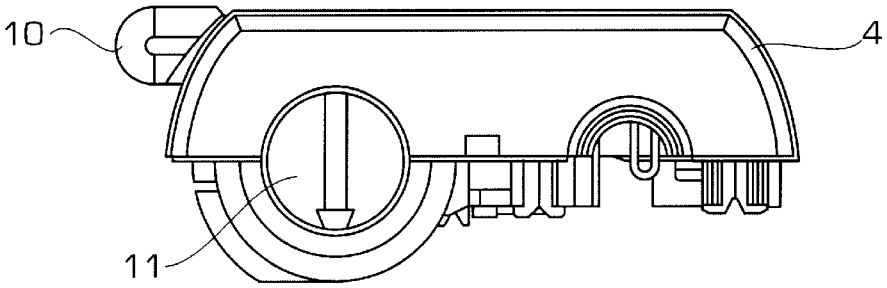
FIG. 7
FIG. 8
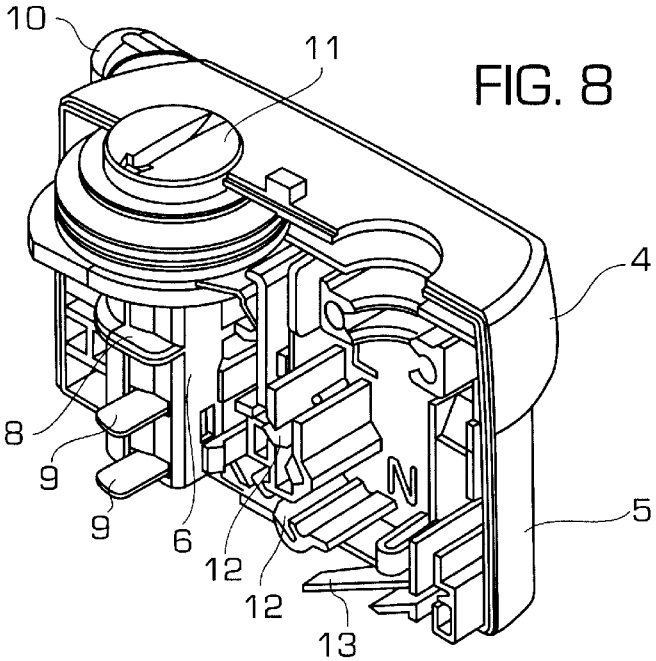

POWER TAKE-OFF ADAPTER FOR A TRACK

The invention relates to a power take-off adapter for a track comprising a longitudinal connection slot and longitudinal current conductors, the power take-off adapter having a box-like frame that comprises: a protruding switching member to be arranged in the connection slot of the conductor track; locking and contact fingers for connecting the power take-off adapter arranged in the connection slot of the track mechanically to the track and electrically to the current conductors of the track; a switching means that is switched from a first position to a second position and from the second position to the first position to move the locking fingers to a connecting position in which they protrude from the switching member and, respectively, to a retracted disconnecting position.

Track systems of this type are today used commonly in various rooms for connecting lighting equipment, appliances and the like to a power source by means of a power take-off adapter. Various types of both adapters and tracks have been developed. As examples of the prior art are mentioned the solutions of Finnish Patents 84,305 and 92,635.

A drawback of the prior art is, for example, the complexity of the constructions, which raises the production costs. The constructional complexity is, for example, due to the fact that in previously known power take-off adapters, after attaching the power take-off adapter, it has been selected mechanically which phase conductor the power take-off adapter is connected to, i.e. which contact finger moves to a connecting position and which remain in a disconnecting position. Due to the mechanical constructions, the number of components has increased, which has raised the production costs. A further drawback is, for example, that when more lighting equipment is installed in a system or when the positions of the lighting devices are changed, some phase of the track system may be loaded too heavily while the other phases are loaded too lightly.

The object of the invention is to provide a power take-off adapter for a track, eliminating the drawbacks of the prior art. This is achieved with the power take-off adapter provided by the invention. The power take-off adapter of the invention is characterized in that the locking and contact fingers are arranged on one and the same axle member; that a rotary movement of the switching means is also arranged to turn all the contact fingers such that they come into contact with the current conductors of the track; and that the power take-off adapter is provided with a selecting switch, by which the power take-off adapter is electrically connected to the desired phase conductor or electrically disconnected from the phase conductor, so that the power take-off adapter can be attached to the track and detached from the track by a single movement of the switching means, while the phase selected by the selecting switch remains unchanged.

The primary advantage of the invention is that it simplifies the constructions of the power take-off adapter and reduces the production costs as compared with the earlier solutions. The number of different components is minimised. Also, no spiral springs or other such components, which are difficult to handle in the assembly, are needed in the power take-off adapter. A further advantage is that the power take-off adapter can be attached and detached by a single movement of a lever, and the phase selected will not change even though the power take-off adapter is attached to or detached from the track. During the selection of the phase, the power take-off adapter can be either attached to or detached from the track. Yet another advantage is that the invention makes it possible to arrange to operate advantageously as parts of the selecting switch.

Figure 2:
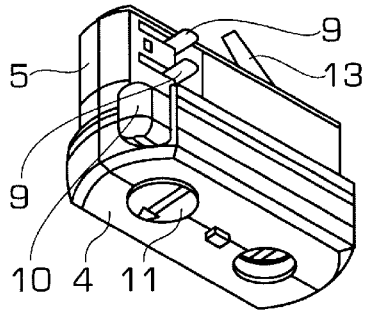
Figure 3:
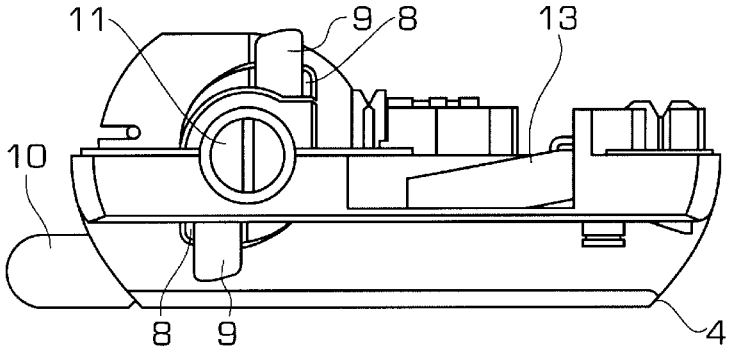
Figure 4:
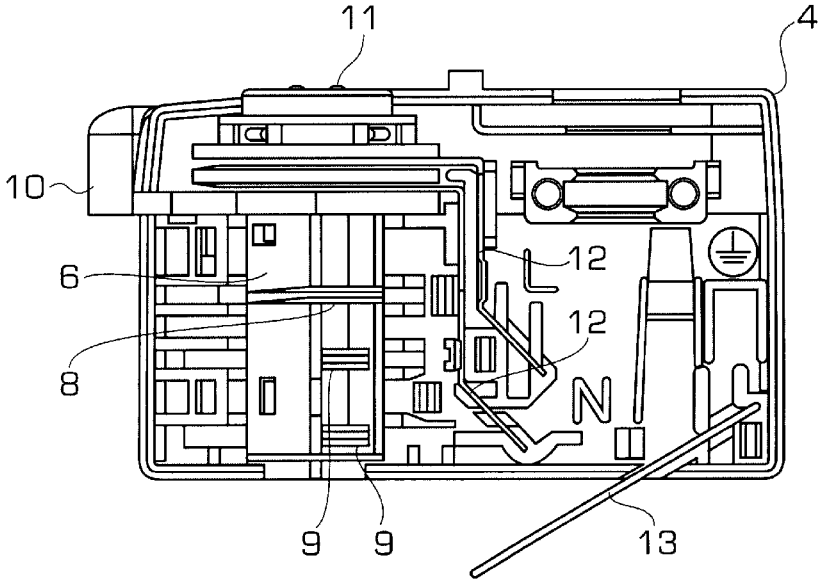
Figure 9:
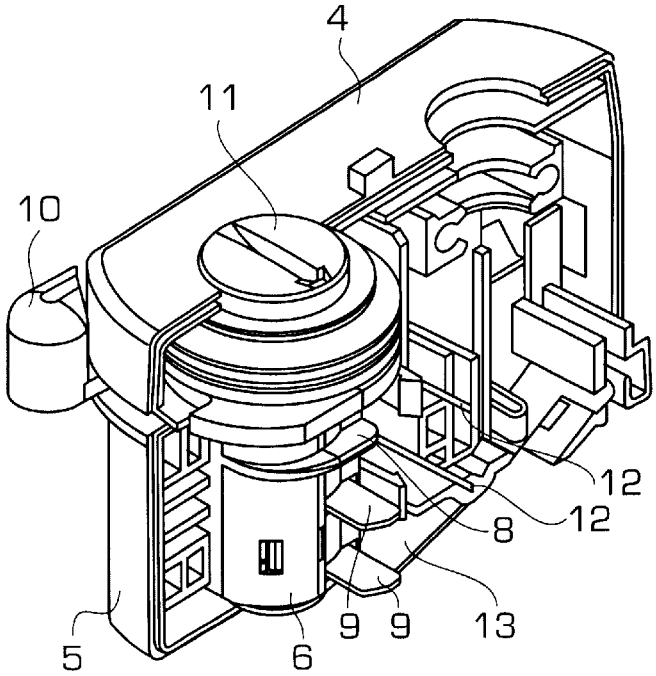
Figure 10:
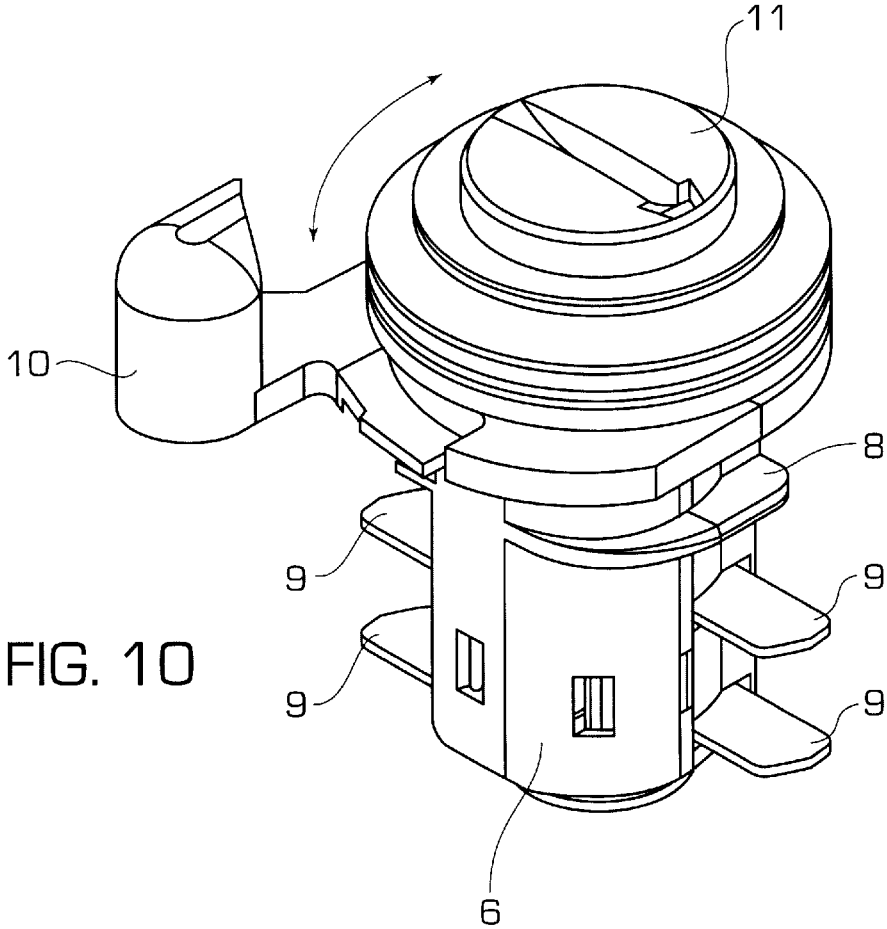
Figure 11:
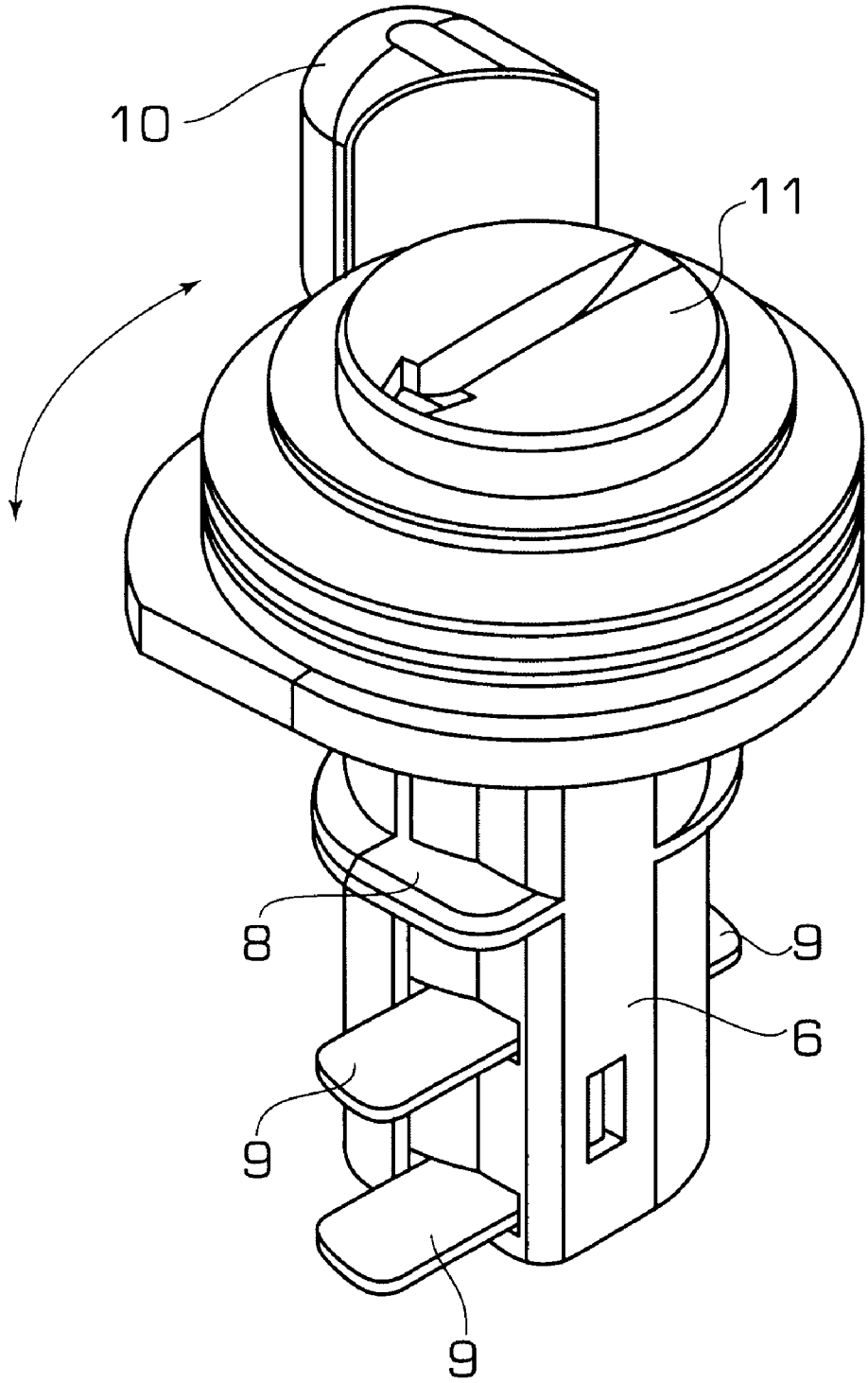

In the following the invention will be described in greater detail by means of a preferred embodiment illustrated in the attached drawing, in which FIG. 1 shows a general view of a track, FIG. 2 shows a general view of a power take-off adapter provided by the invention, FIGS. 3 to 7 show partly sectional views of the power take-off adapter according to the invention seen from different directions, FIGS. 8 and 9 show perspective views of the adapter shown in FIGS. 3 to 7 seen from different directions, and FIGS. 10 and 11 show an axle member of the power take-off adapter according to the invention with the switching means in different positions.

FIG. 1 shows a general view of a track 1. The track 1 can be made, for example, from an aluminium profile. Reference number 2 indicates a longitudinal connection slot of the track. Reference number 3 indicates longitudinal current conductors, i.e. a neutral conductor and phase conductors, of the track.

FIGS. 2 to 9 show general views of a power take-off adapter according to the invention, which can be attached, for example, to a track according to FIG. 1. FIGS. 2 to 9 show a box-like frame 4 of the power take-off adapter. The box-like frame 4 of the power take-off adapter comprises a protruding switching member 5 to be arranged in the connection slot 2 of the track 1.

The power take-off adapter further comprises locking fingers 8 and contact fingers 9. The function of the locking fingers 8 is to connect the power take-off adapter mechanically to the track, whereas the function of the contact fingers 9 is to connect the power take-off adapter electrically to the current conductors 3 of the track.

The locking fingers 8 and contact fingers 9 are controlled by a switching means 10. When the switching means 10 is switched from a first position to a second position, the locking fingers 8 and contact fingers 9 move from a retracted disconnecting position to a protruding connecting position. Correspondingly, when the switching means 10 is switched from the second position to the first position, the locking fingers 8 and contact fingers 9 move from the protruding connecting position to the retracted disconnecting position.

It is an essential feature of the invention that the locking and contact fingers 8,9 are arranged on one and the same axle member 6. A rotary movement of the switching means 10 is arranged to rotate the axle member and to turn not only the locking fingers 8 but also the contact fingers 9 such that they come into contact with the current conductors 3 of the track 1. The power take-off adapter is provided with a selecting switch 11, by which the power take-off adapter is electrically connected to the desired phase conductor 3 or electrically disconnected from the phase conductor 3, so that the power take-off adapter can be attached to the track 1 or detached from the track 1 by a single movement of the switching means 10, while the phase selected by the selecting switch 11 remains unchanged.

The idea of the invention is thus that the power take-off adapter is mechanically connected to the track by a movement of the switching element 10 from a first position to a second position; in other words, the contact fingers come into contact with the neutral and phase conductors 3. The movement of the switching means 10 can be, for example, a movement indicated in FIGS. 10 and 11 by an arrow. FIGS. 10 and 11 show only the axle member 6. It is clear that when the switching means 10 is switched, the locking means 8 move to a protruding position as shown in the figure. The electric connection is provided by the selecting switch 11. The selecting switch 11 can be, for example, a rotating switch that is arranged to control contact strips 12 that effect the electric connection. It should be noted that the phase selected by the selecting switch 11 will not change even though the power take-off adapter is detached from the track 1 or attached to the track 1. This is also significant when the load is to be divided evenly between the different phases. The power take-off adapter can be detached from the track simply by switching the switching means 10 from the second position to the first position, whereby both the locking fingers 8 and the contact fingers 9 move to the retracted position. The selecting switch 11 can thus here be held in the previously selected position, so that the phase will not change in connection with later reconnection. The selecting switch 11 can preferably be placed at the end of the axle member 6 as shown in the example illustrated in the figures. It is clear, however, that the selecting switch can also be other than a rotating switch and that it can also be placed elsewhere than at the end of the axle member. It should also be noted that the phase can be selected or changed when the power take-off adapter is detached from the track. When the power take-off adapter is arranged in the track, the phase selected will not change.

The electric connection of the power take-off adapter according to the invention is, in principle, quite conventional, i.e. the contact fingers are connected in the desired manner to the phase and the neutral. Protective grounding is provided by a contact 13 that is arranged to be in contact with a protective ground conductor arranged at the bottom of the connection slot 2 of the track 1 or with a protective conductor arranged on the side of the connection slot.

The above embodiment is in no way intended to restrict the invention, but the invention can be varied quite freely within the scope of the claims. It is thus obvious that the power take-off adapter of the invention or any of its details need not necessarily be exactly as shown in the figures but that other solutions are also possible. The selecting switch, for example, need not necessarily be a rotating switch as shown in the figures. Other types of switches known per se, such as a sliding clutch, can also be used as the selecting switch, if it is considered necessary. If necessary, the selecting switch can also be placed in any part of the frame whatsoever, as stated above. Further, the shape of the power take-off adapter is not in any way restricted to the shape illustrated in the figures, but the box-like frame can be shaped quite freely according to the need.

I claim:

1. A power take-off adapter for a track (1) comprising a longitudinal connection slot (2) and longitudinal current conductors (3) including a plurality of phase conductors, the power take-off adapter having a box-like frame (4) that comprises a protruding switching member (5) that can be arranged in the connection slot of the conductor track; locking fingers (8) and contact fingers (9) for connecting the power take-off adapter arranged in the connection slot (2) of the track mechanically to the track (1) and electrically to current conductors (3) of the track; switching means (10) that is switched from a first position to a second position and from the second position to the first position for moving the locking fingers (8) to a connecting position in which the locking fingers protrude from the switching member (5) and, respectively, to a retracted disconnected position, characterized in that the locking fingers (8) and contact fingers (9) are arranged on one and the same axle member; that a rotary movement of the switching means (10) is also arranged to turn all the contact fingers (9) so that the contact fingers come into contact with the current conductors (3) of the track (1); and that the power take-off adapter is provided with a selecting switch (11) by which the power take-off adapter is electrically connected to a selected one of the phase conductors or electrically disconnected from the selected one of the phase conductors, so that the power take-off adapter can be attached to the track (1) or detached from the track (1) by a single movement of the switching means (10), while the phase selected switch (11) remains unchanged.

2. A power take-off adapter as claimed in claim 1, characterized in that the desired phase can be selected or changed by the selecting switch (11) when the power take-off adapter is attached to the track (1) or detached from the track (1).

3. A power take-off adapter as claimed in claim 1, characterized in that the selecting switch (11) is a rotating switch.

4. A power take-off adapter as claimed in claim 3, characterized in that the rotating switch is arranged to control contact strips (12) that effect the electric connection.

5. A power take-off adapter as claimed in claim 3, characterized in that rotating switch is arranged at an the end of the axle member.

6. A power take-off adapter for a track, the track comprising a longitudinal connection slot and current conductors including a plurality of phase conductors, the power take-off adapter comprising:

a box-like frame;

a protruding switching member for insertion into the connection slot of the conductor track;

a locking finger for mechanically connecting the power take-off adapter to the track, contact fingers for electrically connecting the power take-off adapter to the phase conductors of the track;

a switching device, switchable between a first position and a second position, which moves the locking finger to a connecting position in which the locking finger protrudes from the switching member and a disconnecting position in which the locking finger is retracted from the switching member, and which moves the contact fingers to a connecting position in which the contact fingers are electrically connected to the current conductors and a disconnecting position in which the contact fingers are electrically disconnected from the current conductors;

an axle member on which both the locking finger and the contact fingers are arranged; and a phase selecting switch for selecting a phase conductor from the current conductors of the track by electrically connecting and disconnecting the power take-off adapter to and from a selected one of the phase conductors; and wherein a movement of the switching device between the first and second positions for connecting and disconnecting the locking finger and contact fingers does not change the selection of the phase conductor selected by the phase selecting switch.

7. The power take-off adapter as claimed in claim 6, adapted so that a phase conductor can be selected by the phase selecting switch when the power take-off adapter is attached to the track and when the power take-off adapter is detached from the track.

8. The power take-off adapter as claimed in claim 6, wherein the phase selecting switch is a rotating switch.

9. The power take-off adapter as claimed in claim 8, wherein the rotating switch controls contact strips that effect the electrical connection.

10. The power take-off adapter as claimed in claim 6, wherein the rotating switch is arranged at an end of the axle member.

* * * * *